US006370776B1

(12) United States Patent
Kanemitsu et al.

(10) Patent No.: US 6,370,776 B1
(45) Date of Patent: Apr. 16, 2002

(54) METHOD OF PRODUCING A POLY-V PULLEY

(75) Inventors: Toshiaki Kanemitsu, Kobe; Masataka Onishi, Miki, both of (JP)

(73) Assignee: Kanemitsu Corporation, Hyogo (JP)

( * ) Notice: Subject to any disclaimer, the term of this patent is extended or adjusted under 35 U.S.C. 154(b) by 0 days.

(21) Appl. No.: 09/674,601

(22) PCT Filed: Apr. 14, 1999

(86) PCT No.: PCT/JP99/01977

§ 371 Date: Nov. 3, 2000

§ 102(e) Date: Nov. 3, 2000

(87) PCT Pub. No.: WO00/61316

PCT Pub. Date: Oct. 19, 2000

(51) Int. Cl.[7] ..... B23P 17/00
(52) U.S. Cl. ..... 29/892; 72/68; 29/892.11
(58) Field of Search ..... 29/892, 892.11, 29/892.3; 474/166–174, 180–183; 72/68, 110; D8/360

(56) References Cited

U.S. PATENT DOCUMENTS 5,651,181 A * 7/1997 Shohara et al. ..... 29/892.3

FOREIGN PATENT DOCUMENTS

| | | | |
|---|---|---|---|
| JP | 61-60230 A | * | 3/1986 |
| JP | 8-300082 | | 11/1996 |
| JP | 10-180386 | | 7/1998 |

* cited by examiner

*Primary Examiner*—P. W. Echols
(74) *Attorney, Agent, or Firm*—Jones, Tullar & Cooper, P.C.

(57) ABSTRACT

The present invention provides a method of producing a poly-V pulley which can economically produce a poly-V pulley of the type that is to be inserted and coupled onto a shaft via a one-way clutch or a bearing, the number of steps being as small as possible. A trunk is obtained by cutting a thick pipe blank into a fixed dimension. Thereafter, first and second preliminary ears are projectingly formed in the axial ends on the outer peripheral face of the trunk by pressing in which the axial end faces of the trunk are clamped between upper and lower dies respectively having annular wedge-like projections, and the wedge-like projections bite the axial end faces of the trunk. The first and second preliminary ears are shaped into first and second ears by rolling of a predetermined shape, and poly-V grooves are thereby formed.

1 Claim, 7 Drawing Sheets

METHOD OF PRODUCING A POLY-V PULLEY

TECHNICAL FIELD

The present invention relates to a method of producing a poly-V pulley which is used together with a V belt for transmitting rotational power.

BACKGROUND ART

As a poly-V pulley of this kind, for the purpose of insertion and coupling onto a shaft via a one-way clutch or a bearing, known is a poly-V pulley of a structure in which a cylindrical trunk is formed, an ear for preventing a V belt from disengaging is formed in each of the axial ends of the outer peripheral face of the trunk, and poly-V grooves are formed between the ears.

A method of producing such a poly-V pulley is disclosed in, for example, Japanese Laid Open Patent Publication No. 8-300082. The disclosed poly-V pulley is produced approximately in the following pressing steps. First, a disk-shaped blank configured by a rolled steel plate is drawn to form a first shaped member of a bottomed cup-like shape. Then, the bottom wall portion of the first shaped member is punched out to form a second shaped member of a bottomless cup-like shape. Thereafter, the second shaped member of a bottomless cup-like shape is shaped into a cylindrical trunk, and a preliminary ear is formed by a pressing work in each of the axial ends of the outer peripheral face of the trunk. Finally, the preliminary ears in the ends of the trunk are shaped into ears of a predetermined shape, and poly-V grooves are formed by a rolling work in the outer peripheral face of the trunk between the ears.

However, a sheet metal made poly-V pulley which is produced from a rolled steel plate by steps all of which are pressing steps requires a large number of steps and a long working time period, and its cost is high. In order to obtain a cylindrical trunk from a shaped member of a bottomed cup-like shape, particularly, the bottom wall portion of the shaped member of a bottomed cup-like shape must be punched out. The bottom wall portion becomes scrap or causes a material loss, and hence is uneconomical. In order to form ears so as to project in a necessary and sufficient manner, a thick blank is necessary. However, it is not easy to draw a thick blank into a bottomed cup-like shape.

It is an object of the invention to provide a method of producing a poly-V pulley which can easily produce a poly-V pulley configured by such a cylindrical trunk by a small number of steps, without producing a material loss, and at a low cost.

SUMMARY OF THE INVENTION

A first method of producing a poly-V pulley of the present invention is a method of producing a poly-V pulley which has a cylindrical trunk, first and second ears for preventing a V belt from disengagement from the trunk, the ears being projectingly formed respectively in axial ends of an outer peripheral face of the trunk, and poly-V grooves formed between the first and second ears on the outer peripheral face of the trunk, wherein the method comprises: a first step of cutting a thick pipe blank into a fixed dimension to obtain the trunk; a second step of projectingly forming first and second preliminary ears in axial ends of the outer peripheral face of the trunk by a pressing work in which axial end faces of the trunk are clamped between upper and lower dies each having an annular wedge-like projection, and the wedge-like projections are caused to bite the axial end faces of the trunk; and a third step of, by a rolling work, shaping the first and second preliminary ears into the first and second ears of a predetermined shape, and forming the poly-V grooves between the first and second ears.

According to the production method, since the trunk is obtained by cutting a thick pipe blank into a fixed dimension, a poly-V pulley of a predetermined shape can be easily obtained by only the two steps, ie., the single pressing step and the rolling step. Furthermore, the problem in the above-described pressing work in the conventional art is eliminated, whereby a material loss is produced by punching out a bottom wall portion of a shaped member of a bottomed cup-like shape.

A variant of the method of producing a poly-V pulley of the present invention is a method of producing a poly-V pulley which has a cylindrical trunk, first and second ears for preventing a V belt from disengagement from the trunk, the ears being projectingly formed respectively in axial ends of an outer peripheral face of the trunk, and poly-V grooves formed between the first and second ears on the outer peripheral face of the trunk, wherein the variant comprises: a first step of cutting a thick pipe blank into a fixed dimension to obtain the trunk; a second step of forming a V-shaped slot over a circumferential direction in an intermediate portion in a thickness direction of each of the axial end faces of the trunk, and projectingly forming first and second preliminary ears in axial ends of the outer peripheral face of the trunk by a first pressing work in which the axial end faces of the trunk are clamped between upper and lower dies each having an annular wedge-like projection, and the wedge-like projections are caused to bite the axial end faces of the trunk; a third step of forming an annular boss portion in a radially inner side with respect to the V-shaped slot of at least one of the axial end faces of the trunk making the V-shaped slot disappear, and increasing a projecting amount of the first preliminary ear or the second preliminary ear in the place by a second pressing work in which annular split pieces of the axial end faces of the trunk and outside the respective V-shaped slots are clamped between the upper and lower dies, thereby inwardly compressing in the axial direction by a depth of the V-shaped slot; and a fourth step of, by a rolling work, shaping the first and second preliminary ears into the first and second ears of a predetermined shape, and forming the poly-V grooves between the first and second ears.

According to the production method, since the trunk is obtained by cutting a thick pipe blank into a fixed dimension in the same manner as the first variant of the present invention, a cylindrical poly-V pulley which has an annular boss portion in at least one end can be easily obtained by the three steps, i.e., the two pressing steps and the rolling step. Furthermore, also the problem in that, as in the above-described pressing work in the conventional art, a material loss is eliminated.

DESCRIPTION OF THE PREFERRED EMBODIMENT OF THE INVENTION

A first embodiment of the method of producing a poly-V pulley according to the present invention will be described with reference to the drawings.

Figure 1:
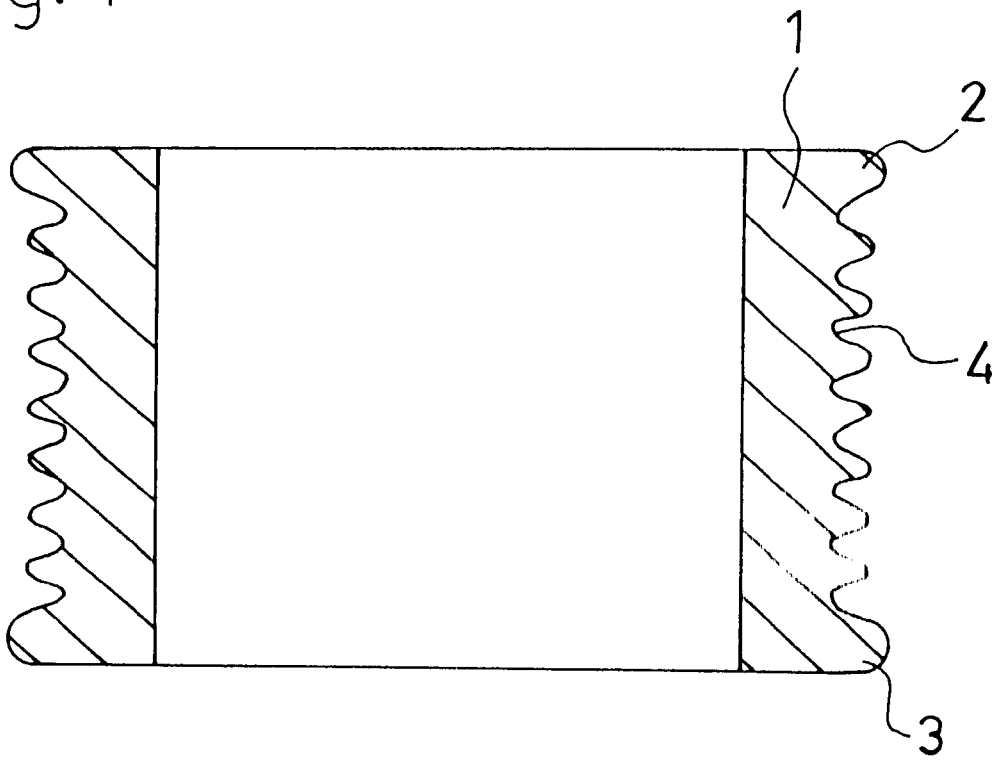
FIG. 1 is a section view of a poly-V pulley which is produced by a first embodiment of the present invention.

FIG. 1 is a section view of a poly-V pulley which is produced by the first embodiment of the present invention. The poly-V pulley has: a cylindrical trunk 1; first and second annular ears 2 and 3 which are projectingly formed respectively from the axial ends on the outer peripheral face of the trunk 1; and poly-V grooves 4 which are formed on the outer peripheral face of the trunk 1 and between the first and second ears 2 and 3. For example, the poly-V pulley is inserted and coupled onto a shaft for power transmission, via a one-way clutch or a bearing. The first and second ears 2 and 3 are restricting walls which prevent a poly-V belt from being accidentally disengaged from the poly-V grooves 4 under a state where the poly-V belt is wound in the poly-V grooves 4.

Next, a method of producing the poly-V pulley will be described with reference to FIGS. 2A to 2E.

Figure 2A:
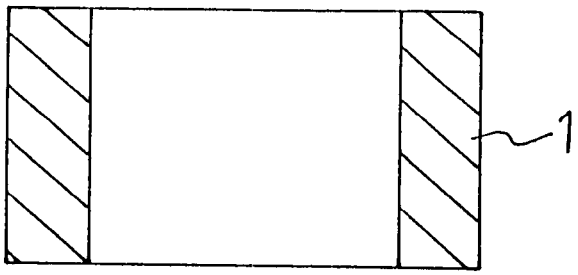
FIGS. 2A to 2E are views of steps of producing the poly-V pulley in the first embodiment of the present invention.

FIG. 2A shows a first step. In this step, a long thick pipe blank of carbon steel or alloy steel which is commercially available is cut into a fixed dimension, thereby obtaining a short trunk 1.

Figure 2B:
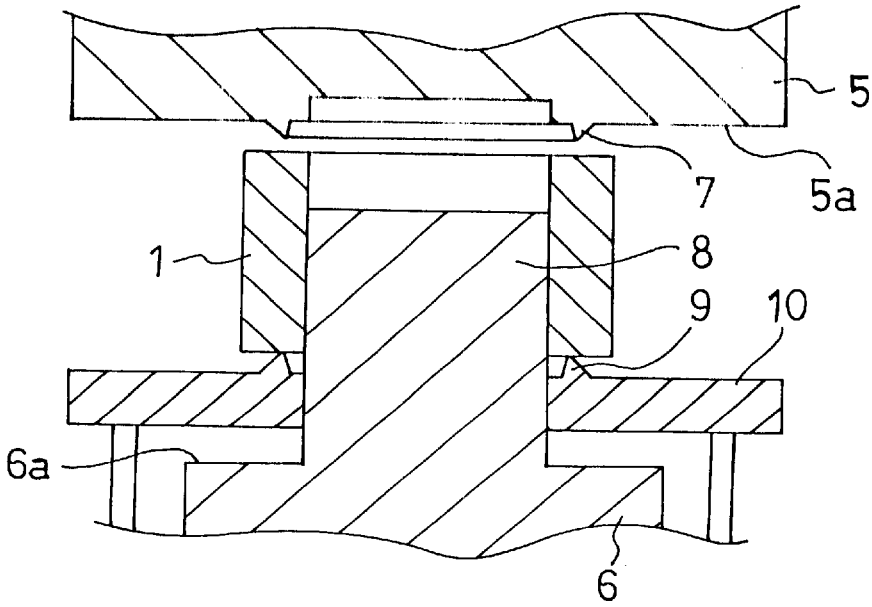
Figure 2C:
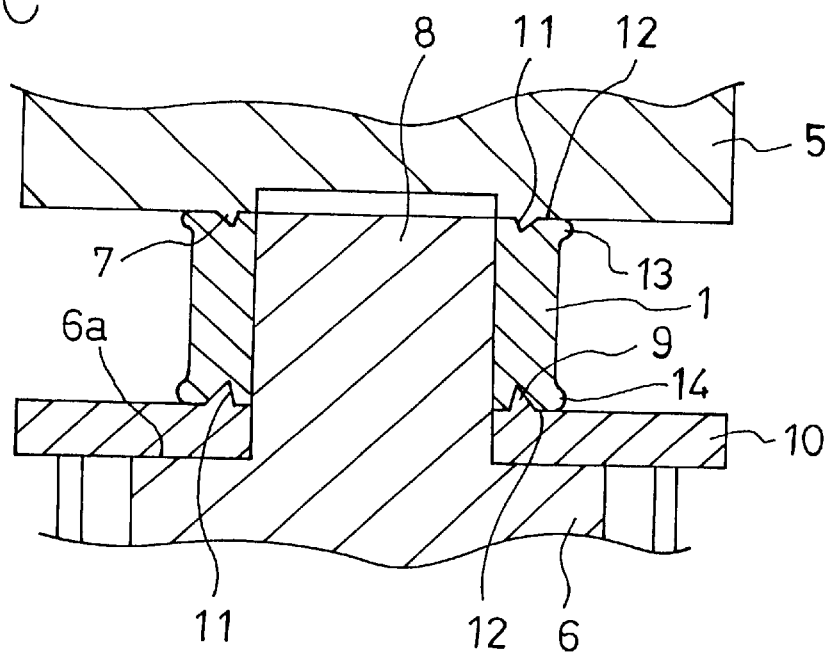

FIGS. 2B and 2C show a second step in which a pressing work is performed. FIG. 2B shows a state before the work, and FIG. 2C shows a state after the work. In the second step, upper and lower dies 5 and 6 are used. The upper die 5 has on a lower end face 5*a*, an annular wedge-like projection 7 having a V-like section shape. The lower die 6 comprises: a columnar male die portion 8 having an outer diameter which is substantially equal to the inner diameter of the trunk 1; and an unwrinkling die 10 which is attached to the outer periphery of the male die portion 8 so as to be vertically movable, and which has an annular wedge-like projection 9 having a V-like section shape.

In the second step, first, the trunk 1 which is obtained in the first step is inserted onto the male die portion 8 of the lower die 6 as shown in FIG. 2B. In this case, the trunk 1 is received and supported by the unwrinkling die 10 which is in the top dead center position, so as to be slightly upward projected from the upper end of the male die portion 8. Then, as shown in FIG. 2C, the upper die 5 is lowered to press down the trunk 1 together with the unwrinkling die 10 until the unwrinkling die 10 reaches the bottom dead center position on a step 6*a* of the lower die 6. Consequently, the wedge-like projection 7 of the upper die 5 bites an intermediate portion in the thickness direction of the upper end face of the trunk 1, and the wedge-like projection 9 of the lower die 6 bites an intermediate portion in the thickness direction of the lower end face of the trunk 1. As a result of this biting, a V-shaped slot 11 is formed in each of the intermediate portions in the thickness direction of the upper and lower end faces of the trunk 1, and first and second preliminary ears 13 and 14 are projectingly formed in outer peripheries of annular split pieces 12 outside the V-shaped slots 11, respectively. This formation of the first and second preliminary ears 13 and 14 is performed in the following manner. The biting of the upper and lower wedge-like projections 7 and 9 into the upper and lower end faces of the trunk 1 is gradually advanced to a deeper position to form the V-shaped slots 11. Since the inner peripheral face of the trunk 1 is contacted with the outer peripheral face of the male die portion 8 of the lower die 6, the annular split pieces 12 outside the V-shaped slots 11 are deformed so as to be opened with outward expanding from the outer peripheral face of the trunk 1, whereby the first and second preliminary ears 13 and 14 are projectingly formed. In the pressing work of the second step, the upper and lower end face of the trunk 1 which are rough cut faces may be formed into smooth faces by the lower end face 5*a* of the upper die 5 and the upper face of the unwrinkling die 10.

Figure 2D:
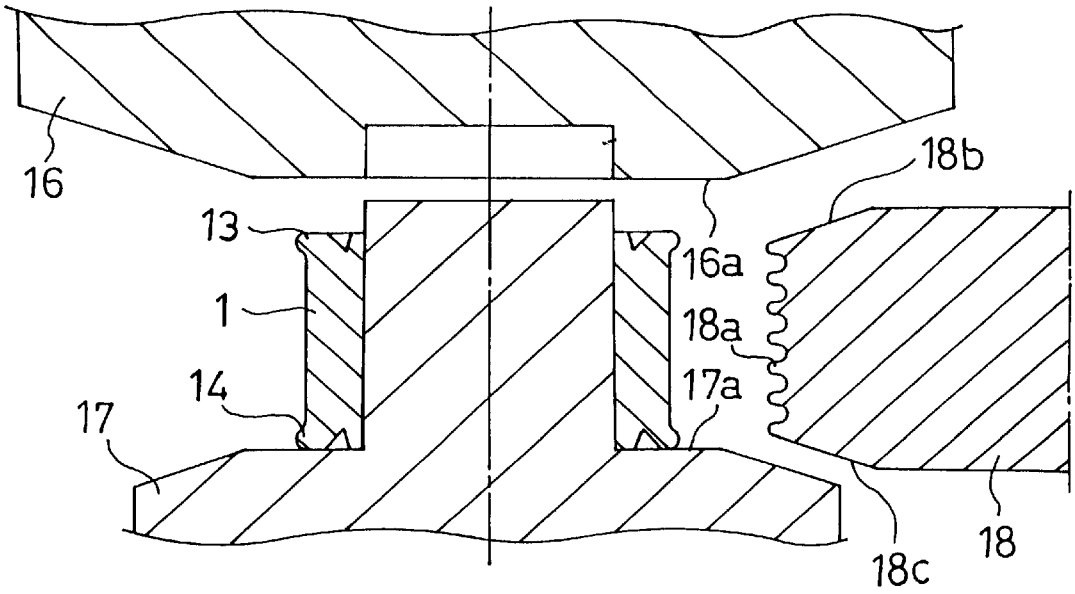
Figure 2E:
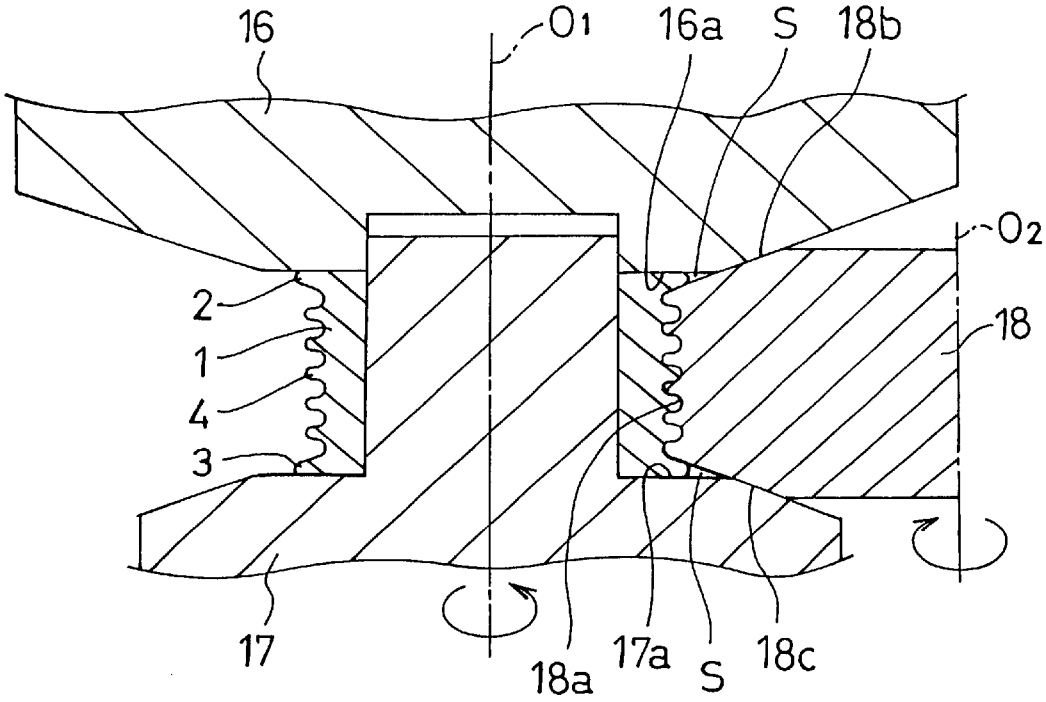

FIGS. 2D and 2E show a third step in which a rolling work is performed. FIG. 2D shows a state before the work, and FIG. 2E shows a state after the work. In the third step, as shown in FIG. 2E, the trunk 1 having the first and second preliminary ears 13 and 14 which are obtained in the second step is clamped between an upper rotary die 16 and a lower rotary die 17 and rotated about $O_1$. A disk-like rolling roller 18 (in FIGS. 2D and 2E, shown in a half section state) is rotated about $O_2$ while grooves 18*a* on the outer periphery of the rolling roller 18 are strongly pressed in a radial direction against the outer periphery of the trunk 1, whereby the first and second preliminary ears 13 and 14 on the outer peripheral face of the trunk 1 are shaped into the first and second ears 2 and 3, and the poly-V grooves 4 configured by a group of V grooves are formed between the first and second ears 2 and 3. In this case, the first and second preliminary ears 13 and 14 are clamped between horizontal steps 16*a* and 17*a* of the upper and lower rotary dies 16 and 17, and upper and lower inclined faces 18*b* and 18*c* of the rolling roller 18, and extended into spaces S which are defined by the portions, whereby the preliminary ears can be shaped into the first and second ears 2 and 3. The projecting amounts of the first and second ears 2 and 3 from the end portion of the trunk 1 can be made slightly larger by the rolling roller 18 than those of the first and second preliminary ears 13 and 14 which are projected from the end portion of the trunk 1 by the pressing work in the second step, so that the first and second ears 2 and 3 can be finish-shaped so as to have a necessary and sufficient projecting length.

The work of shaping the first and second ears 2 and 3 and the poly-V grooves 4 is preferably performed by repeating plural times a rolling process to obtain the depth and pitch of the poly-V grooves of the final shape, rather than by simply conducting one time a rolling process.

Next, a second embodiment of the method of producing a poly-V pulley according to the present invention will be described.

Figure 3:
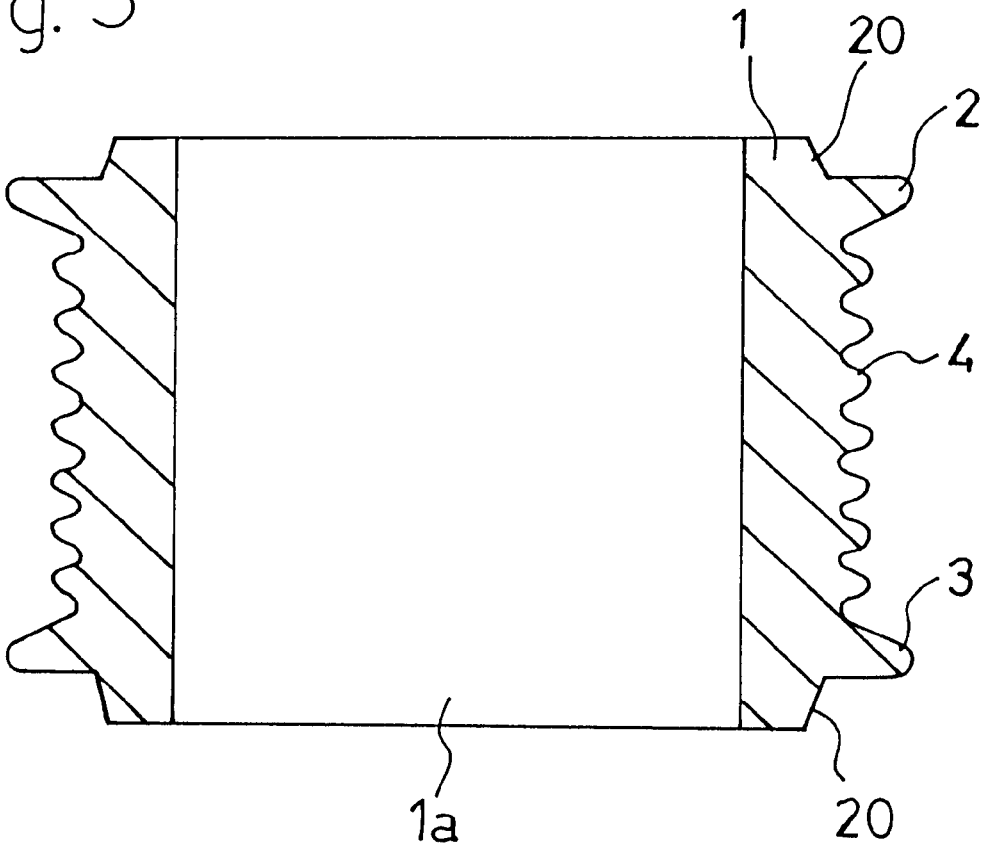
FIG. 3 is a section view of a poly-V pulley which is produced by a second embodiment of the present invention.

FIG. 3 is a section view of a poly-V pulley which is produced by the second embodiment of the present invention. The poly-V pulley is fundamentally identical in structure with the poly-V pulley of the first embodiment, and has: a cylindrical trunk 1; first and second annular ears 2 and 3 which are projectingly formed respectively from the axial ends on the outer peripheral face of the trunk 1; and poly-V grooves 4 which are formed on the outer peripheral face of the trunk 1 and between the first and second ears 2 and 3. The poly-V pulley is different from that of the first embodiment in that an annular boss portion 20 having a diameter which is smaller than the outer diameter of the trunk 1 is formed in each of the axial ends of the trunk 1. The formation of the annular boss portion 20 in one of or both of the axial ends of the trunk 1 enables a center hole 1*a* of the trunk 1 to be ensured to have an axial length which is larger than the interval of the first and second ears 2 and 3, or substantially equal to the axial length of the trunk 1 which is cut into the predetermined dimension in the first step, so as to be necessary and sufficient for housing a one-way clutch or a bearing in the center hole 1*a* of the trunk 1.

A method of producing the poly-V pulley of the second embodiment will be described with reference to FIGS. 4A to 4G. The embodiment consists of four steps, or first to fourth steps. Among the steps, the first and second steps are strictly identical with the first and second steps of the first embodiment.

Figure 4A:
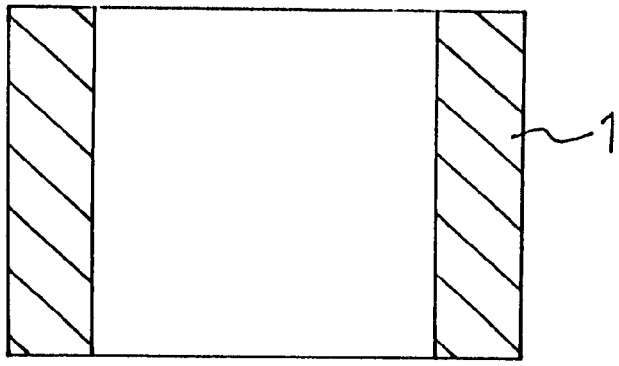
FIGS. 4A to 4G are views of steps of producing the poly-V pulley in the second embodiment of the present invention.

FIG. 4A shows the first step. In this step, a long thick pipe blank of carbon steel or alloy steel which is commercially available is cut into a fixed dimension, thereby obtaining a short trunk 1.

Figure 4B:
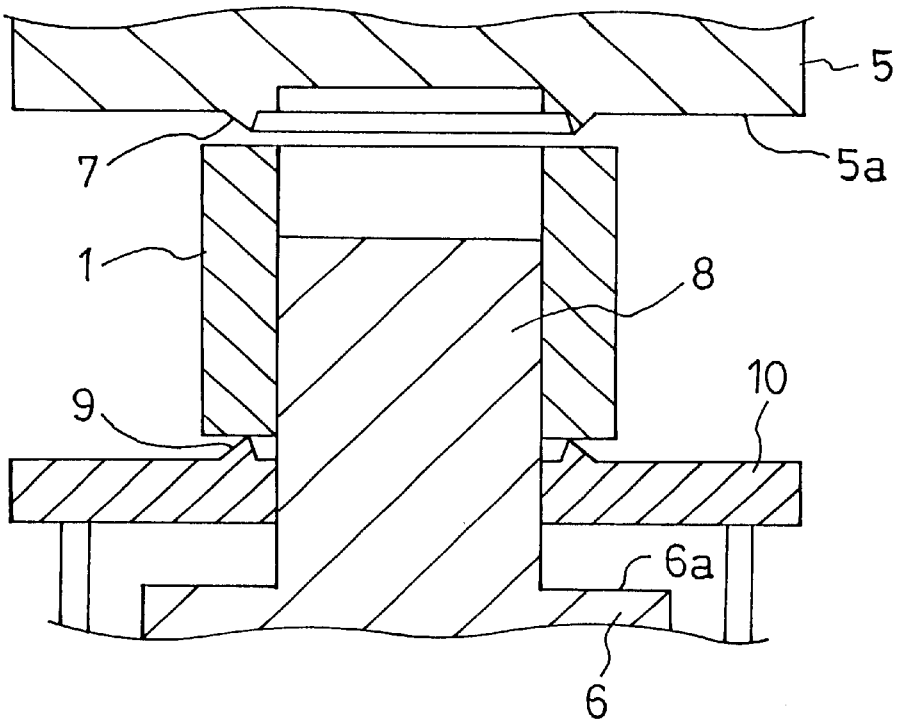
Figure 4C:
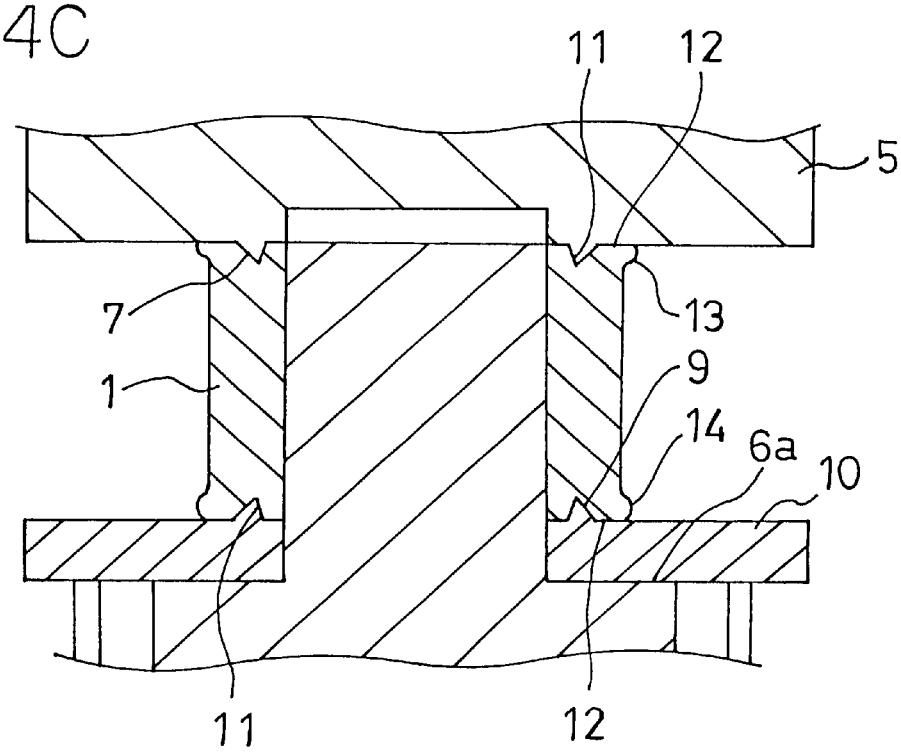

FIGS. 4B and 4C show the second step in which a first pressing work is performed. FIG. 4B shows a state before the work, and FIG. 4C shows a state after the work. In the second step, upper and lower dies 5 and 6 are used in the same manner as the second step in the first embodiment. The upper die 5 has on a lower end face 5*a*, an annular wedge-like projection 7 having a V-like section shape. The lower die 6 comprises: a columnar male die portion 8 having an outer diameter which is substantially equal to the inner diameter of the trunk 1; and an unwrinkling die 10 which is attached to the outer periphery of the male die portion 8 so as to be vertically movable, and which has an annular wedge-like projection 9 having a V-like section shape.

In the second step, first, the trunk 1 which is obtained in the first step is inserted onto the male die portion 8 of the lower die 6 as shown in FIG. 4B. In this case, the trunk 1 is received and supported by the unwrinkling die 10 which is in the top dead center position, so as to be slightly upward projected from the upper end of the male die portion 8. Then, as shown in FIG. 4C, the upper die 5 is lowered to press down the trunk 1 together with the unwrinkling die 10 until the unwrinkling die 10 reaches the bottom dead center position on a step 6*a* of the lower die 6. Consequently, the wedge-like projection 7 of the upper die 5 bites an intermediate portion in the thickness direction of the upper end face of the trunk 1, and the wedge-like projection 9 of the lower die 6 bites an intermediate portion in the thickness direction of the lower end face of the trunk 1. As a result of this biting, a V-shaped slot 11 is formed in each of the intermediate portions in the thickness direction of the upper and lower end faces of the trunk 1, and first and second preliminary ears 13 and 14 are projectingly formed in outer peripheries of annular split pieces 12 outside the V-shaped slots 11, respectively. As described above, the manner of forming the first and second preliminary ears 13 and 14 is strictly identical with that of the case of the second step of the first embodiment.

Figure 4D:
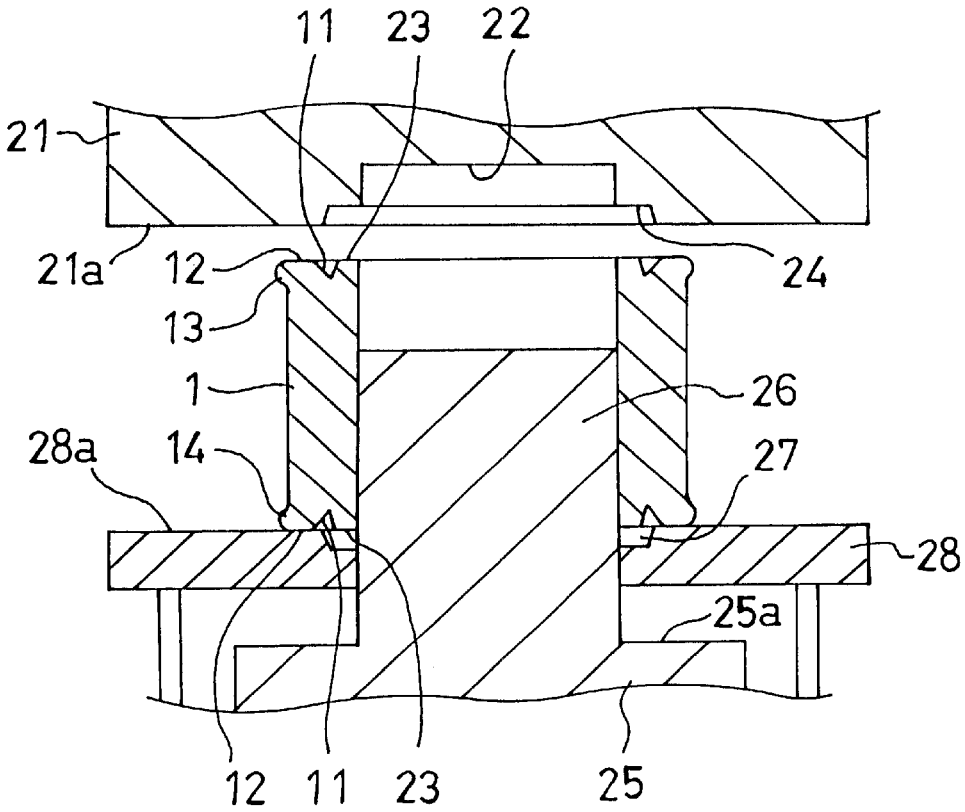
Figure 4E:
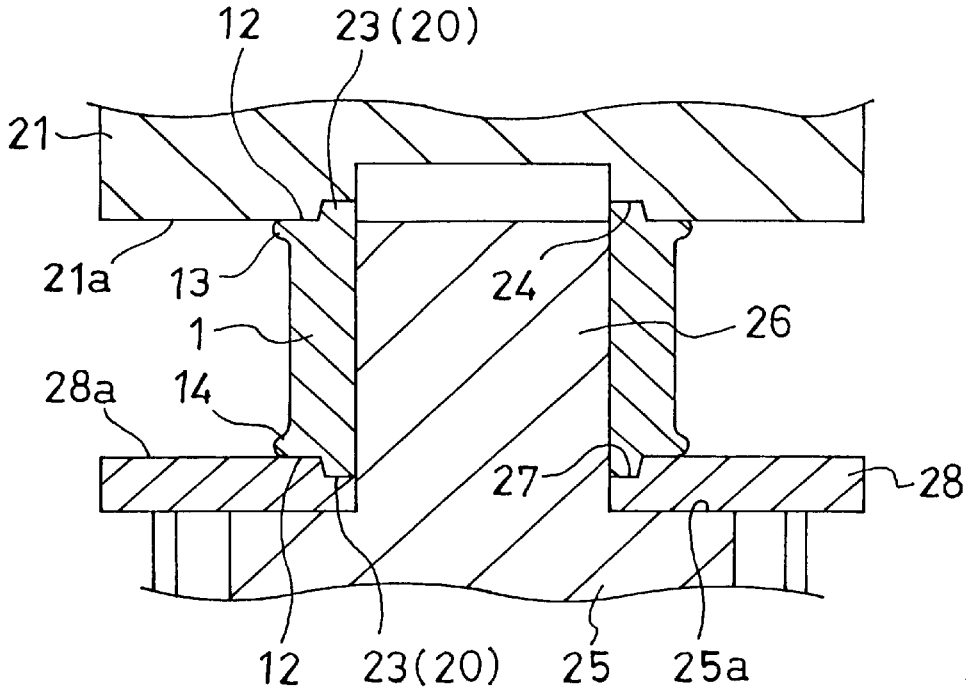

FIGS. 4D and 4E show a third step in which a second pressing work is performed. In an upper die 21 which is used in the third step, an annular recess 24 is formed in the outer periphery of a center recess 22 of a lower end face 21*a* of the upper die 21. The recess has a depth which is shallower than the depth of the center recess 22, and a shape which receives an annular split piece 23 inside the V-shaped slot 11 in the upper end face of the trunk 1. By contrast, the lower die 25 comprises a columnar male die portion 26 having an outer diameter which is substantially equal to the inner diameter of the trunk 1, and an unwrinkling die 28 which is attached to the outer periphery of the male die portion 26 so as to be vertically movable, and which has in the inner periphery an annular recess 27 of a shape which receives the annular split piece 23 inside the V-shaped slot 11 in the lower end face of the trunk 1.

In the third step, first, the trunk 1 having the first and second preliminary ears 13 and 14 which are obtained in the second step is inserted onto the male die portion 26 of the lower die 25 as shown in FIG. 4D. In this case, the trunk 1 is received and supported by the unwrinkling die 28 which is in the top dead center position, so as to be slightly upward projected from the upper end of the male die portion 26. Then, as shown in FIG. 4E, the upper die 21 is lowered to press down the trunk 1 together with the unwrinkling die 28 until the unwrinkling die 28 reaches the bottom dead center position on a step 25*a* of the lower die 25. As a result, between a horizontal lowest end face 21*a* in the outer periphery of the annular recess 24 of the upper die 21, and a horizontal upper end face 28*a* in the outer periphery of the annular recess 27 of the unwrinkling die 28 of the lower die 25, a compression load is applied to the annular split piece 12 outside the V-shaped slot 11 of the upper end face of the trunk 1, and the annular split piece 12 outside the V-shaped slot 11 of the lower end face of the trunk. Since the trunk 1 receives such a compression load, the axial length between the upper and lower outer annular split pieces 12 of the trunk 1 is shortened, the thickness is increased outward in a radial direction of the trunk 1, and also the projecting amounts of the first and second preliminary ears 13 and 14 are slightly increased. At the same time when the portion between the upper and lower outer annular split pieces 12 of the trunk 1 is compressively deformed as described above, the annular split pieces 23 inside the upper and lower V-shaped slots 11 respectively enter the annular recesses 24 and 27 of the upper and lower dies 21 and 25 to form the annular boss portions 20, and the V-shaped slots 11 are made to disappear.

Figure 4F:
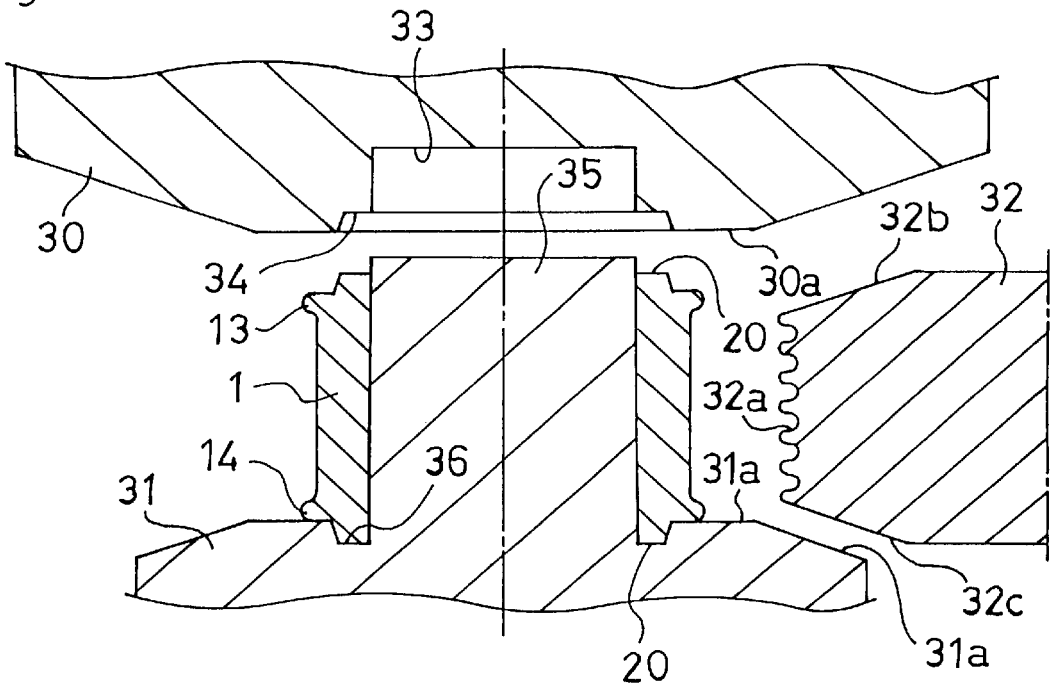
Figure 4G:
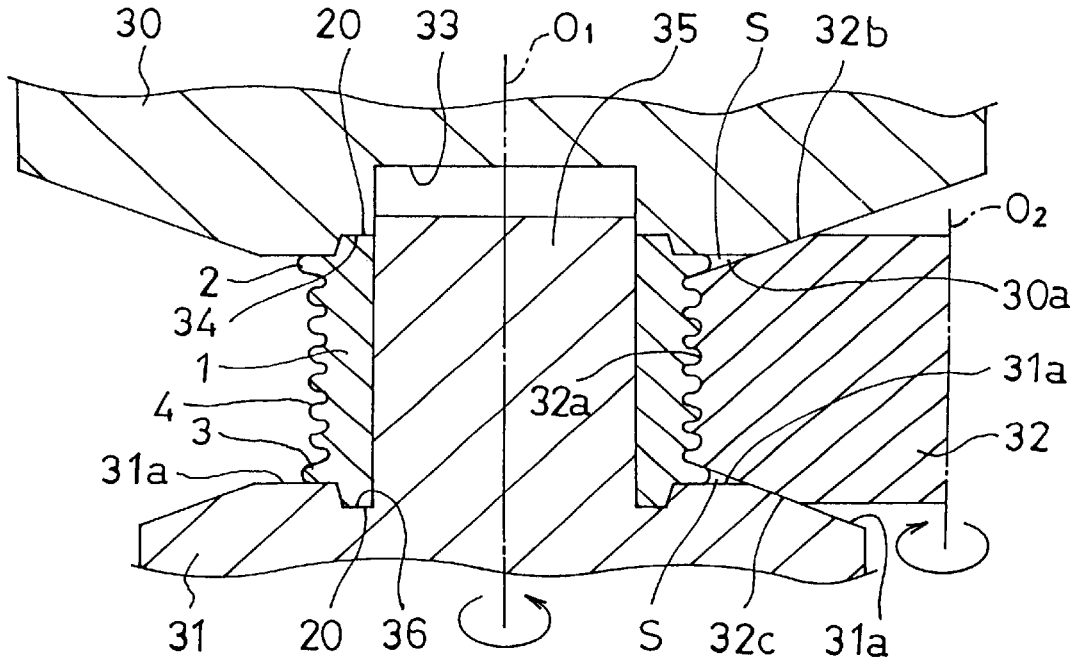

FIGS. 4F and 4G show a fourth step in which a rolling work is performed. FIG. 4F shows a state before the work, and FIG. 4G shows a state after the work. In the fourth step, an upper rotary die 30, a lower rotary die 31, and a disk-like rolling roller 32 (in FIGS. 4F and 4G, shown in a half section state) are used. In the upper rotary die 30, an annular recess 34 is formed in the outer periphery of a center recess 33 of a lower end face 30*a* of the upper die. The recess has a depth which is shallower than the depth of the center recess 33, and a shape into which the annular boss portion 20 of the upper end face of the trunk 1 is to be fitted. By contrast, in the lower rotary die 31, a columnar male die portion 35 having an outer diameter which is substantially equal to the inner diameter of the trunk 1 is projected from the center of an upper end face 31*a* of the lower die, and an annular recess 36 of a shape into which the annular boss portion 20 of the lower end face of the trunk 1 is to be fitted is formed in the whole periphery of the root portion of the male die portion 35.

In the fourth step, first, the trunk 1 having the first and second preliminary ears 13 and 14 and the annular boss portions 20 which are obtained in the third step is inserted onto the male die portion 35 of the lower rotary die 31, and the annular boss portion 20 of the lower end face of the trunk is fitted into the annular recess 36 of the lower rotary die 31 as shown in FIG. 4F.

Then, as shown in FIG. 4G, the upper rotary die 30 is lowered to cause the center recess 33 of the die to be fitted onto the upper end portion of the male die portion 35 of the lower rotary die 31, and the annular recess 34 to be fitted onto the annular boss portion 20 of the upper end face of the trunk 1, whereby the trunk 1 is clamped between the upper rotary die 30 and the lower rotary die 31.

Thereafter, the upper rotary die 30 and the lower rotary die 31 are rotated together with the trunk 1 about $O_1$, and the rolling roller 32 is rotated about $O_2$ while grooves 32*a* on the outer periphery of the rolling roller 32 are strongly pressed in a radial direction against the outer periphery of the trunk 1, whereby the first and second preliminary ears 13 and 14 on the outer peripheral face of the trunk 1 are shaped into the first and second ears 2 and 3, and the poly-V grooves 4 configured by a group of V grooves are formed between the first and second ears 2 and 3. In this case also, in the same manner as the first embodiment, the work of shaping the first and second ears 2 and 3 and the poly-V grooves 4 is preferably performed by repeating plural times a rolling process to obtain the depth and pitch of the poly-V grooves of the final shape.

In this case, the first and second preliminary ears 13 and 14 are clamped between the horizontal lower and upper end faces 30*a* and 31*a* of the upper and lower rotary dies 30 and 31, and upper and lower inclined faces 32*b* and 32*c* of the rolling roller 32, and extended into spaces S which are defined by the portions, whereby the preliminary ears can be shaped into the first and second ears 2 and 3. The projecting amounts of the first and second ears 2 and 3 from the end portion of the trunk 1 can be made slightly larger by the rolling roller 32 than those of the first and second preliminary ears 13 and 14 which are projected from the end portion of the trunk 1 by the pressing work in the third step, so that the first and second ears 2 and 3 can be finish-shaped so as to have a necessary and sufficient projecting length.

During the rolling, the annular boss portion 20 of the upper end of the trunk 1 is fitted into the annular recess 34 of the upper rotary die 30, and the annular boss portion 20 of the lower end of the trunk 1 is fitted into the annular recess 36 of the lower rotary die 31. Therefore, the trunk 1 can be surely held between the upper and lower rotary dies 30 and 31. This contributes to achievement of highly accurate shaping of the first and second ears 2 and 3 and the poly-V grooves 4 by the rolling roller 32.

In the second embodiment described above, the annular boss portion 20 is formed in each of the upper and lower end faces of the trunk 1. The invention is not restricted to this. The annular boss portion 20 may be formed in only one of the upper and lower end faces of the trunk 1.

According to the present invention, a cylindrical trunk is obtained by cutting a thick pipe blank which is commercially available into a fixed dimension, first and second preliminary ears are formed on the trunk by a single pressing step, and the first and second preliminary ears are then shaped into first and second ears, and poly-V grooves are shaped by rolling. Therefore, a cylindrical poly-V pulley of the type that is to be inserted and coupled onto a shaft via a one-way clutch or a bearing can be produced easily and economically by steps the number of which is as small as possible. Since a pressing work in which wedge-like projections of the upper and lower dies bit the axial end faces of the trunk is employed, the first and second preliminary ears which serve as bases for the first and second ears can be projectingly formed in an easy manner on the axial ends on the outer peripheral face of the trunk.

Further according to the invention, a cylindrical trunk is obtained by cutting a thick pipe blank which is commercially available into a fixed dimension, an annular boss portion and first and second preliminary ears are formed on. the trunk by two pressing steps, and the first and second preliminary ears are finally shaped into first and second ears, and poly-V grooves are shaped by rolling. Also in the embodiment, therefore, a cylindrical poly-V pulley having an annular boss portion and of the type that is to be inserted and coupled onto a shaft via a one-way clutch or a bearing can be produced easily and economically by steps the number of which is as small as possible. Furthermore, the first and second preliminary ears which serve as bases for the first and second ears can be formed in an easy manner by the first pressing work, and the annular boss portion can be formed in an easy manner by the second pressing work.

What is claimed is:

1. A method of producing a poly-V pulley which has a cylindrical trunk, first and second ears for preventing a V belt from being disengaged from the trunk, the ears projecting respectively from axial ends of an outer peripheral face of the trunk, and poly-V grooves formed between the first and second ears on the outer peripheral face of the trunk, the method comprising the steps of cutting a thick pipe blank into a fixed dimension to obtain the trunk; forming a V-shaped slot over a circumferential direction in an intermediate portion in a thickness direction of each of the axial end faces of the trunk, and forming first and second preliminary ears to project outwardly from axial ends of the outer peripheral face of the trunk by a first pressing in which the axial end faces of the trunk are clamped between upper and lower dies each having an annular wedge-like projection, and the wedge-like projections are caused to bite the axial end faces of the trunk; forming an annular boss portion in a radially inner side with respect to the V-shaped slot of at least one of the axial end faces of the trunk, thereby removing the V-shaped slot, and increasing the projecting amount of the first preliminary ear or the second preliminary ear by a second pressing in which annular split pieces of the axial end faces of the trunk which are outside the respective V-shaped slots are clamped between the upper and lower dies, thereby inwardly compressing in the axial direction to a depth of the V-shaped slot; and shaping by rolling the first and second preliminary ears into the first and second ears of a predetermined shape, forming the poly-V grooves between the first and second ears.

* * * * *